US007101102B2

(12) United States Patent
Sawa

(10) Patent No.: US 7,101,102 B2
(45) Date of Patent: Sep. 5, 2006

(54) CAPLESS WRITING INSTRUMENT

(75) Inventor: Yukinori Sawa, Fujioka (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 0 days.

(21) Appl. No.: 10/524,890

(22) PCT Filed: Sep. 5, 2003

(86) PCT No.: PCT/JP03/11383

§ 371 (c)(1),
(2), (4) Date: Feb. 16, 2005

(87) PCT Pub. No.: WO2004/022360

PCT Pub. Date: Mar. 18, 2004

(65) Prior Publication Data

US 2006/0002755 A1 Jan. 5, 2006

(30) Foreign Application Priority Data

Sep. 6, 2002 (JP) ..... 2002-261340
Sep. 6, 2002 (JP) ..... 2002-261426

(51) Int. Cl.
*B43K 5/16* (2006.01)

(52) U.S. Cl. ..... 401/107; 401/108

(58) Field of Classification Search ..... 401/107, 401/108, 122, 99, 132
See application file for complete search history.

(56) References Cited

U.S. PATENT DOCUMENTS 3,480,370 A * 11/1969 Koeln ..... 401/107
3,594,091 A * 7/1971 Bleuer ..... 401/107
4,711,592 A * 12/1987 Gregory ..... 401/107
6,033,141 A 3/2000 Blaustein et al.
6,478,495 B1 * 11/2002 Ami et al. ..... 401/107

FOREIGN PATENT DOCUMENTS

| | | | |
|---|---|---|---|
| JP | 49-32731 | | 3/1974 |
| JP | 49-107421 | | 3/1974 |
| JP | 172133/1981 | | 5/1983 |
| JP | 58-89394 | U | 6/1983 |
| JP | 63-23084 | U | 2/1988 |
| JP | 1-281999 | A | 11/1989 |
| JP | 5-39914 | Y2 | 10/1993 |
| JP | 2002-187395 | A | 7/2002 |
| JP | 2002-293082 | A | 10/2002 |

* cited by examiner

*Primary Examiner*—Tuan Nguyen
(74) *Attorney, Agent, or Firm*—Buchanan Ingersoll PC

(57) ABSTRACT

A capless writing instrument (1), wherein a writing element (5) is arranged inside a barrel cylinder (2) so that a pen point (6) of the writing element (5) can come out and retract through a front end opening of the barrel cylinder (2), is characterized in that an inner cap (20) formed of rubber or elastic resin is provided at the front end opening of the barrel cylinder (2), and the inner cap (20) is composed of: a closing portion (21) disposed on the pen point projecting side with respect to the axial direction of the barrel cylinder for closing the front end opening and having a slit (25) for allowing the pen point (6) to project and retract; and forward projected portions (27) that are projected from the outer periphery of the closing portion (21) toward the front end opening, and the inner cap is fitted inside the barrel cylinder so that, in the slit (25) closed state, force which is directed approximately perpendicular to the slit surfaces will act inward from the outer periphery of the forward projected portions (27).

6 Claims, 5 Drawing Sheets

CAPLESS WRITING INSTRUMENT

TECHNICAL FIELD

The present invention relates to a capless writing instrument, in particular relates to a capless writing instrument having an anti-dryout mechanism.

BACKGROUND ART

Conventionally, writing instruments, such as water-based and oil-based marker pens and water-based ball-point pens and fountain pens, are generally provided with a cap for sealing the tip part, in order to prevent the writing instrument from becoming unable to write due to dryout of ink at the tip of the writing element.

In the case of a writing instrument having a cap as above, it is necessary to remove and attach the cap every time the pen is used and this work bothers the user if the pen is used frequently. This is why many types of so-called capless writing instruments, which do not need to have a separate cap, have been proposed.

However, such capless writing instruments, in place of a cap, need to have a sealing mechanism for sealing the front end part, in the narrow hollow interior of the writing instrument body, but such sealing mechanisms of conventional configurations are all complicated, needing many components, this results in complexity in assembly and increase in production cost.

To deal with the above problem, as a sealing method of the writing tip, Japanese Utility Model Application Laid-Open Sho 49 No. 32731 (which will be called prior art example 1, hereinbelow) discloses a configuration in which a valve plate having cuts formed radially outwardly from the center therein is arranged at the front end part inside the barrel cylinder of the writing instrument so that the writing tip can be projected through the cuts. Japanese Utility Model Application Laid-Open Sho 49 No. 107421 (which will be called prior art example 2, hereinbelow) discloses another configuration in which packings are arranged at the proximal and front ends inside the barrel cylinder of the writing instrument so that the barrel cylinder interior can be sealed and the writing tip can be projected out through the front end packing against which the tip is abutted. Still another disclosure is proposed in Japanese Utility Model Application Laid-Open Sho 63 No. 23084 (which will be called prior art example 3, hereinbelow), in which an elastic self-closing element having an opening is provided at the front part of a cap body so that the pen point of the barrel cylinder front end can projected out.

There are still other methods. Japanese Patent Application Laid-Open Hei 1 No. 281999 (which will be called prior art example 4, hereinbelow) discloses a configuration in which a sealing means is provided at the front end inside the barrel cylinder of a writing instrument so as to open and close the front end side of the sealed compartment in which the pen point of the writing element is held and the front end side of the sealed compartment is opened when the pen point is projected from the front end. Japanese Utility Model Application Laid-Open Sho 58 No. 89394 (which will be called prior art example 5, hereinbelow) discloses a method in which a sealing structure for sealing the pen tip is hermetically fitted to the front end part of the front barrel at the front end inside the barrel cylinder of the writing instrument so that it opens and closes the front part of the fixed sealing structure as the front barrel moves.

However, according to the above prior art examples 1, 2 and 3, since openings have been formed from the beginning at their sealing portions through which the pen point is projected, any of these configurations involves problems in sealing.

On the other hand, the method described in the prior art example 4 has the problem that the arrangement of the sealed compartment, seal opening and closing mechanism and the like becomes complicated. Similarly, the arrangement described in the prior art example 5 needs to provide separate parts for the sealed compartment with an opening mechanism, hence cannot avoid becoming complicated.

The present invention has been devised in view of the above conventional problems and it is therefore an object of the present invention to provide a capless writing instrument with a simple structure that can assure the sealability at the front end part inside the barrel cylinder.

DISCLOSURE OF INVENTION

In order to achieve the above object, the present invention has the following configurations.

The first aspect of the present invention resides in a capless writing instrument, wherein a writing element is arranged inside a barrel cylinder so that a pen point of the writing element can come out and retract through a front end opening of the barrel cylinder, characterized in that an inner cap formed of rubber or elastic resin is provided at the front end opening of the barrel cylinder, and the inner cap is composed of: a closing portion disposed on the pen point projecting side with respect to the axial direction of the barrel cylinder for closing the front end opening and having a slit for allowing the pen point to project and retract; and forward projected portions that are projected from the outer periphery of the closing portion toward the front end opening, and the inner cap is fitted inside the barrel cylinder so that, in the slit closed state, force which is directed approximately perpendicular to the slit surfaces will act inward from the outer periphery of the forward projected portions.

The second aspect of the present invention resides in the capless writing instrument having the first feature of the present invention, wherein projections are formed on the outer periphery of the forward projected portions of the inner cap or on the inner surface of the barrel cylinder opposing and in contact with the outer periphery of the forward projected portions, and the outer periphery of the front end part is pressed inward by the function of the projections so that force which is directed approximately perpendicular to the slit surfaces will act inward.

The third aspect of the present invention resides in the capless writing instrument having the first feature of the present invention, wherein the slit has a straight form, or has the simplest slit form.

The fourth aspect of the present invention resides in the capless writing instrument having the first feature of the present invention, wherein the closing portion of the inner cap is projected arch-like (dome-like) toward the front end opening.

The fifth aspect of the present invention resides in a capless writing instrument, wherein a writing element is arranged inside a barrel cylinder so that a pen point of the writing element can come out and retract through a front end opening of the barrel cylinder, characterized in that an inner cap formed of rubber or elastic resin is provided at the front end opening of the barrel cylinder, and the inner cap is composed of: a closing portion disposed on the pen point projecting side with respect to the axial direction of the barrel cylinder for closing the front end opening and having a slit for allowing the pen point to project and retract; a cylinder portion formed to the rear from the outer periphery of the closing portion; and a holder disposed in the rear of the cylinder portion and fitted into the cylinder portion so as to spread the cylinder bore, and the inner cap is fitted inside the barrel cylinder so that stress that will constantly cause the slit to close always acts on the closing portion.

The sixth aspect of the present invention resides in the capless writing instrument having the fifth feature of the present invention, wherein the cylinder bore of the inner cap is stretched in the diametrical direction by the range of 5 to 30%, preferably approximately 20%.

The seventh aspect of the present invention resides in the capless writing instrument having the fifth feature of the present invention, wherein projections are formed between the cylinder bore of the inner cap and the holder's peripheral cylinder surface, at predetermined positions so as to stretch the cylinder bore of the inner cap in the direction substantially aligned with the cut direction of the slit.

The eighth aspect of the present invention resides in the capless writing instrument having the fifth feature of the present invention, wherein the closing portion of the inner cap is projected arch-like toward the front end opening.

According to the present invention, the following operations can be made.

Specifically, a capless writing instrument wherein a writing element is arranged inside a barrel cylinder so that a pen point of the writing element can come out and retract through a front end opening of the barrel cylinder, is constructed such that an inner cap formed of rubber or elastic resin is provided at the front end opening of the barrel cylinder, and the inner cap includes a closing portion disposed on the pen point projecting side with respect to the axial direction of the barrel cylinder for closing the front end opening and having a slit for allowing the pen point to project and retract, and the inner cap is fitted inside the barrel cylinder under the condition that the closing portion is stressed so as to close the slit. Thus, the slit is constantly tensioned in its closing direction so as to enhance the sealability at the pen point projecting portion, whereby it is possible to secure the confinement near the pen point inside the barrel cylinder.

Further, since formation of the closing portion in the inner cap into a shape which is projected arch-like (dome-like) toward the front end opening makes it possible to improve the rigidity of the closing portion, it is possible to tightly close the slit when force acts on the slit is in closing direction.

Moreover, provision of an appropriately projected rim around the slit enhances the rigidity in the direction normal to the slit surfaces, hence stabilizes the slit contactness.

In addition, according to the present invention, a capless writing instrument wherein a writing element is arranged inside a barrel cylinder so that a pen point of the writing element can come out and retract through a front end opening of the barrel cylinder, is constructed such that an inner cap formed of rubber or elastic resin is provided at the front end opening of the barrel cylinder, and the inner cap includes a closing portion disposed on the pen point projecting side with respect to the axial direction of the barrel cylinder for closing the front end opening and having a slit for allowing the pen point to project and retract, and is fitted inside the barrel cylinder under the condition that stretch force is subjected to the cylinder portion at the rear end of the inner cap. Thus, the closing portion is constantly tensioned in the slit closing direction so as to enhance the sealability at the pen point projecting portion, whereby it is possible to secure the confinement state of the pen point.

Further, since the cylinder bore of the inner cap is stretched in the direction substantially aligned with the cut direction of the slit provided in the closing portion, it is possible to produce stress in such a direction as to make the slit surfaces into contact, to thereby achieve reliable slit contactness.

As has been described, according to the present invention, it is possible to solve the conventional problems such as imperfect confinement at the slit-like sealing portion and inability in reducing cost due to complicated structures of seal opening and closing mechanism and the like.

According to the present invention, the effects as follows can be obtained.

Specifically, according to the present invention, the inner cap is formed of rubber or elastic resin, including: a closing portion having a slit on its front side for allowing the pen point to project and retract and closing the front end opening; and forward projected portions projected from the outer periphery of the closing portion toward the front end opening, and is fitted inside the barrel cylinder under such conditions that, when the slit is closed, forces directed substantially normal to the slit surfaces press the forward projected portion inward from its outer periphery. Thereby, stress entailing the deformation of the outer periphery is transmitted across the closing portion and acts as the pressure for tightening the slit surfaces, thus making it possible with a simple configuration to seal the barrel interior at the front end part. As a result it is possible to secure confinement of the pen point and hence provide a capless writing instrument excellent in long storage life at a low cost.

Further, according to the present invention, the inner cap is formed of rubber or elastic resin, and includes: a closing portion disposed on its pen point projecting side with respect to the axial direction of the barrel cylinder for closing the front end opening and having a slit for allowing the pen point to project and retract; a cylinder portion formed to the rear from the outer periphery of the closing portion; and a holder disposed in the rear of the cylinder portion and fitted into the cylinder portion so as to spread the cylinder bore, so that stress that will constantly cause the slit to close always acts on the closing portion, thus making it possible with a simple configuration to seal the barrel interior at the front end part. As a result it is possible to secure confinement of the pen point and hence provide a capless writing instrument excellent in long storage life at a low cost.

BEST MODE FOR CARRYING OUT THE INVENTION

The embodiment of the present invention will be described hereinbelow with reference to the drawings.

THE FIRST EMBODIMENT

Figure 1:
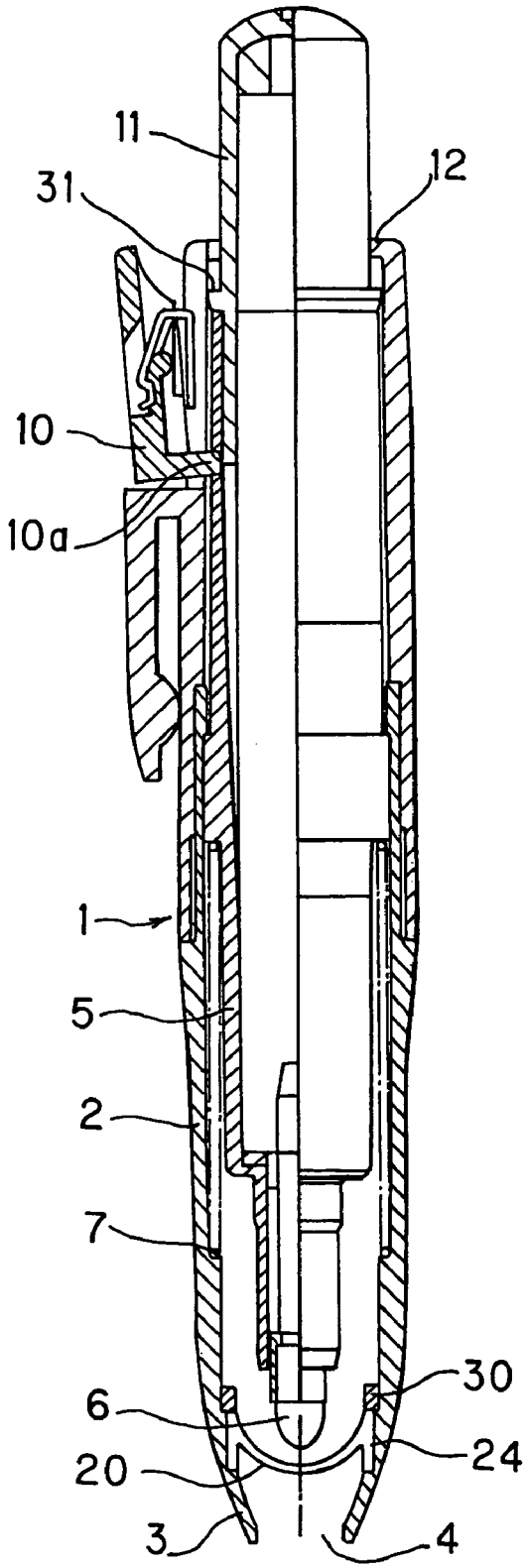
FIG. 1 is a sectional view showing the overall configuration of a capless writing instrument according to the first embodiment of the present invention.
Figure 2:
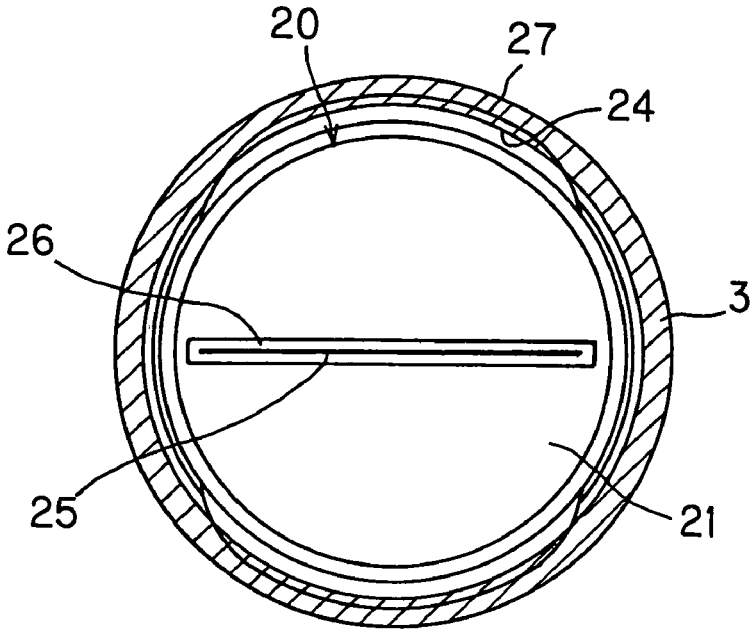
FIG. 2 is a sectional view along a radial plane showing the state in which an inner cap is attached to a barrel cylinder of the capless writing instrument.
Figure 3:
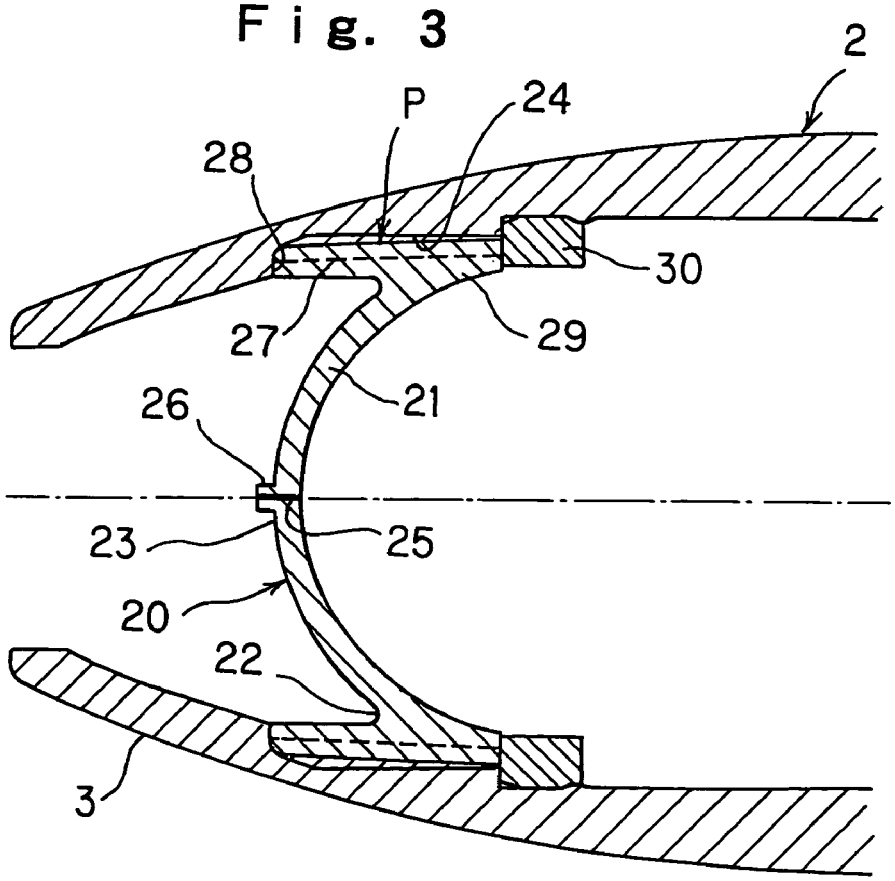
FIG. 3 is a sectional view along the axial direction showing the state in which the inner cap is attached to the barrel cylinder.

FIGS. 1 to 3 show one example of the embodiment of the present invention. FIG. 1 is a sectional view showing the overall configuration of a capless writing instrument according to the first embodiment of the present invention; FIG. 2 is a sectional view along a radial plane showing the state in which an inner cap is attached to a barrel cylinder of the capless writing instrument; and FIG. 3 is a sectional view along the axial direction showing the state in which the inner cap is attached to the barrel cylinder.

To begin with, a capless writing instrument 1 has a writing element 5 disposed inside a barrel cylinder 2 as shown in FIG. 1 and is constructed so that a pen point 6 of writing element 5 is projectable through an opening 4 formed at the front end part 3 of the barrel cylinder 2.

The writing element 5 is pressed rearwards by a coil spring 7 that is disposed along the front inner periphery of barrel cylinder 2 and held at its rear end. Writing element 5 is formed with a clicking portion 11 for projecting the pen point 6. This clicking portion 11 is projected from the rear end 12 of the barrel cylinder, and as this clicking portion 11 is moved forward, pen point 6 is engaged by an engaging mechanism 10 either in a projected or retracted position with respect to the opening 4. In other words, the engaging mechanism 10 is provided in the rear part of barrel cylinder 2 and holds the pen point 6 in a projected or retracted position with respect to the opening 4.

Concerning the engaging mechanism 10, various types have been known beyond the configuration illustrated, but the structure is not the main topic of the present invention so the description is omitted. Also, clicking portion 11 may be provided separately at the rear end of writing element 5.

Provided at the front end part 3 inside the barrel cylinder 2 is an inner cap 20 having an arch-like closing portion 21 projected frontward, as shown in FIGS. 1 and 3. This closing portion 21 has a slit 25 which lies diametrically as a straight line segment that cuts approximately the center 23 of closing portion 21 and terminates at base 22. Further a projected rim 26 is formed along the slit 25.

The inner cap 20 is formed of rubber such as silicone rubber or elastic resin material and is formed with forward projected portions 27 that project toward the front opening from the outer periphery of the base 22 of the arch-like (dome-like) closing portion 21. The forward projected portions 27 are fitted to depressed portions 24 (inner fitting surface for the forward projected portion) formed in the bore of front end part 3 of barrel cylinder 2 in such a manner that the front edges of forward projected portions 27 abut the front ends 28 of depressed portions 24 while appropriate force is made to act on the outer periphery of each forward projected portion 27 inwardly from the direction perpendicular to the slit surfaces.

As the other materials for inner cap 20, rubber materials such as EPDM, butyl rubber, fluororubber and the like, which present excellent non-permeability to ink solvents, may be used. This further prevents the ink solvent from evaporating from the front side of inner cap 20.

In this embodiment, forward projected portions 27, which are projected tongue-like at positions perpendicular to the slit surfaces from base 22, are fitted to the depressed portions 24 in the bore of the front end part 3 of barrel cylinder 2 so as to produce stress (indicated by an arrow P in FIG. 3) entailing deformation at predetermined positions in the front end or in the rear of the periphery, whereby the stress is transmitted along sealing element 21 to act as the tightening force for shutting the slit surfaces against each other. However, the present invention should not be limited to this. For example, the same function can be obtained by providing a full circumferential forward projected portion while forming projections projected perpendicular to the slit surfaces on its outer periphery or forming projections that press the outer periphery of the forward projected portions on the bore surface of the front end part of the barrel cylinder.

In the present embodiment, slit 25 is formed in the simplest slit form, i.e., in a straight line form, but the present invention should not be limited to this. For example, if a slit with three cuts that radially extend from the center of the closing portion is formed, it is possible to form similar forward projected portions or projections that provide the function of substantially closing the slit surfaces as stated above.

Further, a rear projected portion 29 is formed from the rear of the base 22 and an annular stopper 30 is fixed with its front end abutted against the rear end of the rear projected portion. In this case, inner cap 20 is fixed by being held between the front end 28 of depressed portion 24 and the front end of stopper 30.

The rear projected portion 29 may be formed around the full circumference so that its outer periphery comes into close contact with the peripheral surface of the bore of barrel cylinder 2 to form the seal of the rear side of inner cap 20. Alternatively, a stopper 30 may be tightly fitted into the bore of the barrel cylinder so as to be in close contact with the rear end of the rear projected portion 29 thus formed around the full circumference, forming a seal.

Moreover, in the present embodiment, the shape of closing portion 21 of the inner cap 20 is specified to be arch-like (dome-like), but the shape of the closing portion of the present invention should not be limited to this. For example, the closing portion may be formed in a flat configuration or in a concavely depressed configuration, or may be formed in a conical or polygonal pyramidal configuration.

Next, the operation of the capless writing instrument 1 according to the present embodiment will be described.

To begin with, when the capless writing instrument 1 is not used, the pen point 6 together with writing element 5 is retracted within barrel cylinder 2, as shown in FIG. 1.

When the capless writing instrument 1 is used, the user grips barrel cylinder 2 and pushes clicking portion 11 formed at the rear end of writing element 5 forward opposing the repulsive force of coil spring 7, whereby the writing element 5 moves forward.

An engaging portion 10*a* formed at the front end of engaging mechanism 10 is fitted through a window formed in barrel cylinder 2, and engages an engaging step 31 formed in the rear part of the writing element 5 on the periphery in the front end of clicking portion 11, so that the writing element 5 is stopped and engaged at the forward position.

In this state, the pen point 6 pushes the slit 25 of closing portion 21 of inner cap 20 open and is set so as to be projected from opening 4 at the front end part 3 of barrel cylinder 2.

When the engaged state of the engaging mechanism 10 is released from the projected position, the writing element 5 is retracted into barrel cylinder 2 by virtue of the spring force of coil spring 7.

At the same time, the pen point 6 retracts through slit 25 into barrel cylinder 2, and the slit 25 of inner cap 20 is tightly closed by the elastic force of silicone rubber and by the force acted from the outside to the inside of closing portion 21.

As a result, it is possible to minimize ink evaporation through the slit 25 when the capless writing instrument 1 is not used.

THE SECOND EMBODIMENT

Next, the second embodiment of the present invention will be described with reference to the drawings.

Figure 4:
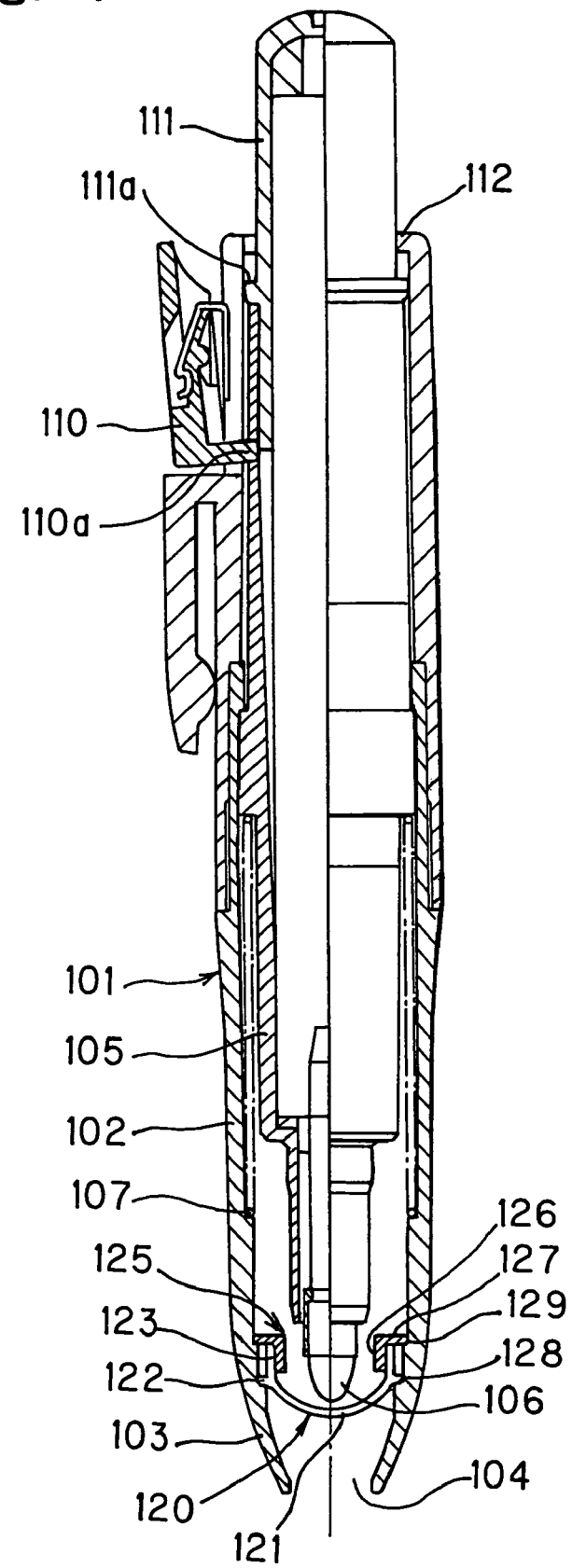
FIG. 4 is a sectional view showing the overall configuration of a capless writing instrument according to the second embodiment of the present invention.
Figure 5:
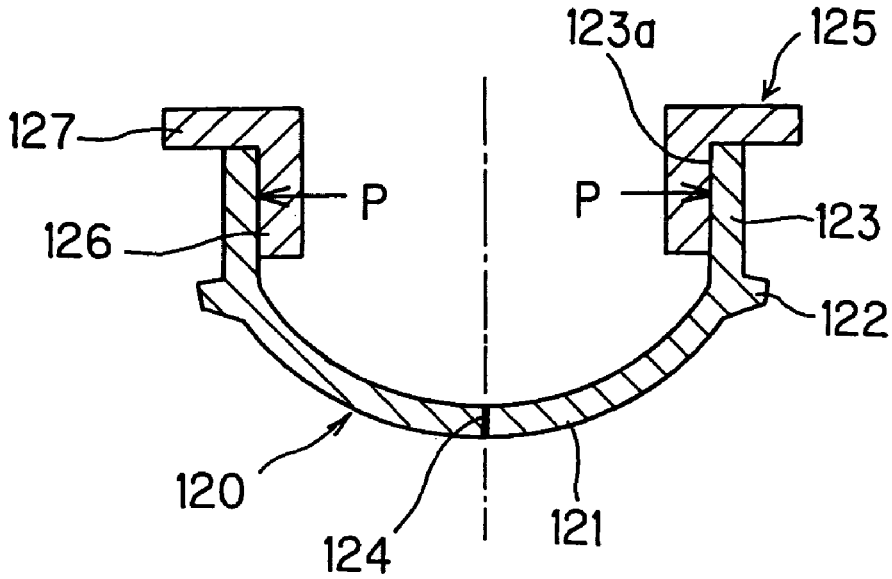
FIG. 5 is a sectional view along a radial plane showing the state in which a holder is fitted into an inner cap of the capless writing instrument.
Figure 6:
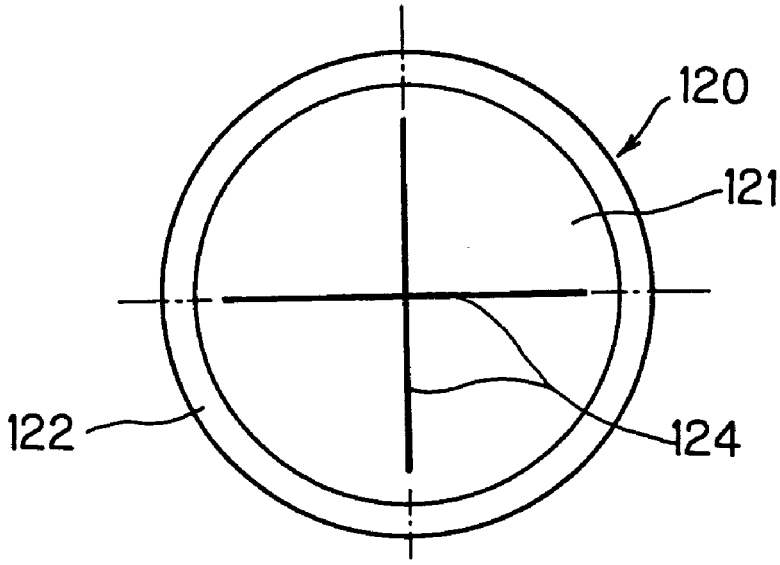
FIG. 6 is a front view showing the structure of the inner cap.
Figure 7:
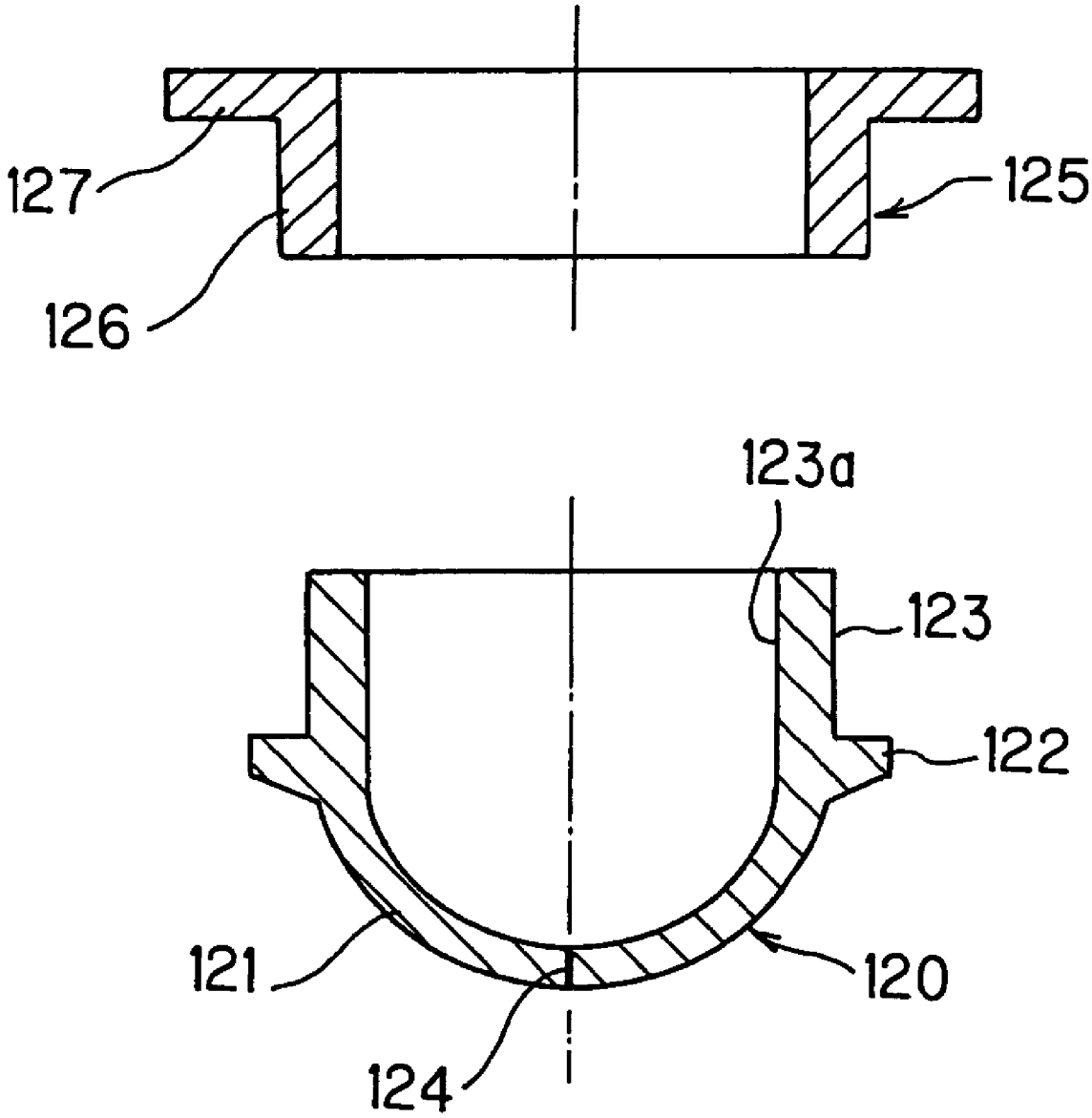
FIG. 7 is an illustrative view showing the state in which the inner cap is not yet attached to the holder.

FIGS. 4 to 7 show the second embodiment of the present invention. FIG. 4 is a sectional view showing the overall configuration of a capless writing instrument according to the second embodiment of the present invention; FIG. 5 is a sectional view along a radial plane showing the state in which a holder is fitted into an inner cap of the capless writing instrument; FIG. 6 is a front view showing the structure of the inner cap; and FIG. 7 is an illustrative view showing the state in which the inner cap is not yet attached to the holder.

To begin with, a capless writing instrument 101 has a writing element 105 disposed inside a barrel cylinder 102 as shown in FIG. 4 and is constructed so that a pen point 106 of writing element 105 is projectable through an opening 104 formed at the front end part 103 of the barrel cylinder 102.

The writing element 105 is pressed rearwards by a coil spring 107 that is disposed along the front inner periphery of barrel cylinder 102 and held at its rear end. Writing element 105 is formed with a clicking portion 111 for projecting the pen point 106. This clicking portion 111 is projected from the rear end 112 of the barrel cylinder, and as this clicking portion 111 is moved forward, pen point 106 is engaged by an engaging mechanism 110 either in a projected or retracted position with respect to the opening 104. In other words, the engaging mechanism 110 is provided in the rear part of barrel cylinder 102 and holds the pen point 106 in a projected or retracted position with respect to the opening 104.

Concerning the engaging mechanism 110, various types have been known beyond the configuration illustrated, but the structure is not the main topic of the present invention so the description is omitted. Also, clicking portion 111 may be provided separately at the rear end of writing element 105.

As shown in FIG. 4, the front end part 103 inside barrel cylinder 102 is fixed with an inner cap 120 having a closing portion 121 projected forwards in an arch-like form.

The inner cap 120 has a holder 125 fitted to its rear end bore and is formed with a flange 122 at the outer periphery of the closing portion 121. The inner cap is positioned and fixed by holder 125 to the bore of the front end part 103 with the flange 122 substantially abutted against a front step 128 formed on the bore surface of front end part 103 and the front end of a flange 127 of holder 125 abutted against a rear step 129 formed in the rear of the front step 128.

Further, as shown in FIGS. 5 to 7, the inner cap 120 is formed of rubber material or elastic resin, and closing portion 121 has a cross-shaped slit 124 that intersects diametrically at substantially the center of the flange 122 and closing portion 121. Further, the flange 122 is projected appropriately from the outer periphery of arch-shaped (dome-shaped) closing portion 121, and a cylinder portion 123 is formed in the rear of flange 122.

In order to stretch the cylinder bore 123*a* (in the directions P), a cylindrical portion 126 that is formed in the front part of holder 125, is formed so as to be appropriately greater in diameter than the cylinder bore 123*a* and is fitted into the cylinder bore 123*a*, so that stress that will constantly cause closing portion 121 to close the slit 124 is applied.

The amount of extension of cylinder bore 123*a* of inner cap 120 in the diametrical direction is set in the range of 5 to 30%, preferably set at approximately 20% though it naturally depends on the design conditions such as the hardness of the material of the inner cap 120, the size and wall thickness of the cylinder portion 123, the shape and wall thickness of closing portion 121 and the shape and number of slit 124. This extension creates such stress in closing portion 121 as to close the slit 124 or recover the sealing surface backwards in an efficient manner.

Though the number of cuts of the slit is not limited, a straight-shaped slit and cross-shaped slit that cuts through the center of closing portion and three to six cuts laid radially from the center are preferred in order to recover the sealing surface backwards efficiently.

Further, the cylinder bore 123*a* of inner cap 120 is formed so as to be stretched in the direction that is substantially the same as the direction of slit 124. Extension of the cylinder bore 123*a* of inner cap 120 in the direction that is substantially the same as the direction of slit 124 formed in closing portion 121 creates stress that will cause the slit surfaces to come into contact.

In order to stretch the cylinder bore of the inner cap, projections for stretching the cylinder bore of the inner cap may be formed between the cylinder bore of the inner cap and the holder's peripheral cylinder surface, at predetermined positions substantially aligned with the cut direction of the slit. When the holder's cylinder portion has a polygon form, the corners can serve as the projections.

When the slit has the simplest shape, i.e., a straight-line form, a holder having its cylinder portion having an oval or elliptic section may be fitted into the cylinder bore of the inner cap with its major axis aligned with the slit direction, so that it is possible to obtain stress that will efficiently make the slit surfaces into contact.

Moreover, in the present embodiment, as a shape of the closing portion for efficient recovery of the sealing surface backward the shape of closing portion 121 of the inner cap 120 is specified to be arch-like (dome-like), but the shape of the closing portion of the present invention should not be limited to this. For example, the closing portion may be formed in a flat configuration or in a concavely depressed configuration, or may be formed in a conical or polygonal pyramidal configuration.

The material of the inner cap 120 is not particularly limited as long as it is made of rubber or elastic resin. Examples of such materials include ethylene propylene rubber (EPDM), butyl rubber (IIR), silicone rubber (Q), chloroprene rubber (CR), acrylonitrile-butadiene rubber (NBR), urethane rubber (U), fluoro rubber (FKM), chlorosulfonated polyethylene rubber (CSM), epichlorohydrin rubber, polysulfide rubber, olefin thermoplastic elastomer, and blended materials such as a blend of the aforementioned rubbers, a blend of any of the above rubbers and a resin material.

It is preferred that a rubber material presenting excellent non-permeability to ink solvents is used. It is also possible to provide more efficient prevention against evaporation of the ink solvent from the front end side of inner cap 120 by providing a membrane that presents excellent non-permeability, as required.

Next, the operation of the capless writing instrument 101 according to the present embodiment will be described.

To begin with, when the capless writing instrument 101 is not used, the pen point 106 together with writing element 105 is retracted within barrel cylinder 102, as shown in FIG. 4.

When the capless writing instrument 101 is used, the user grips barrel cylinder 102 and pushes clicking portion 111 formed at the rear end of writing element 105 forward opposing the repulsive force of coil spring 107, whereby the writing element 105 moves forward.

An engaging portion 110*a* formed at the front end of engaging mechanism 110 is fitted through a window formed in barrel cylinder 102, and engages an engaging step 111*a* formed in the rear part of the writing element on the periphery in the front end of clicking portion 111, so that the writing element 105 is stopped and engaged at the forward position.

In this state, the pen point 106 pushes the slit 124 of closing portion 121 of inner cap 120 open and is set so as to be projected from opening 104 at the front end part 103 of barrel cylinder 102.

When the engaged state of the engaging mechanism 110 is released from the projected position, the writing element 105 is retracted into barrel cylinder 102 by virtue of the spring force of coil spring 107.

At the same time, the pen point 106 retracts through slit 124 into barrel cylinder 102, and the slit 124 of inner cap 120 is tightly closed by the elastic force of silicone rubber and by the force acted from the outside to the inside of closing portion 121.

As a result, it is possible to minimize ink evaporation through slit 124 when the capless writing instrument 101 is not used.

INDUSTRIAL APPLICABILITY

The writing instrument according to the present invention is to hermetically confine the front end thereof so as to prevent inability to write due to dryout at the tip of the writing element of a water-based or oil-based marker pen, water-based ball-point pen or fountain pen, and in particular, is suitable for so-called capless writing instruments, which do not need any separate cap and hence do not need removal of the cap every time the pen is used.

The invention claimed is:

1. A capless writing instrument, wherein a writing element is arranged inside a barrel cylinder so that a pen point of the writing element can come out and retract through a front end opening of the barrel cylinder, wherein an inner cap formed of rubber or elastic resin is provided at the front end opening of the barrel cylinder, and the inner cap is composed of: a closing portion disposed on the pen point projecting side with respect to the axial direction of the barrel cylinder for closing the front end opening and having a slit for allowing the pen point to project and retract; and forward projected portions that are projected from the outer periphery of the closing portion toward the front end opening, and projections are formed on the outer periphery of the forward projected portions or on the inner surface of the barrel cylinder opposing and in contact with the outer periphery of the forward projected portions, so that, in the slit closed state, force which is directed approximately perpendicular to the slit surfaces will act inward from the outer periphery of the forward projected portions by the function of the projections;

wherein when the inner cap is not positioned in the inner end of the barrel cylinder the inner cap has a first position where the forward projected portions are a first distance apart from one another thereby creating a first force in a direction perpendicular to the surfaces of the slits, and when the inner cap is positioned in the end of the barrel cylinder the inner cap has a second position where the forward projected portions are a second distance apart from one another thereby creating a second force in a direction perpendicular to the surfaces of the slits, the second distance being smaller than the first distance, and the second force being larger than the first force.

2. The capless writing instrument according to claim 1, wherein the slit is formed so that its rim is projected forward.

3. A capless writing instrument, wherein a writing element is arranged inside a barrel cylinder so that a pen point of the writing element can come out and retract through a front end opening of the barrel cylinder, wherein an inner cap formed of rubber or elastic resin is provided at the front end opening of the barrel cylinder, and the inner cap is composed of: a closing portion disposed on the pen point projecting side with respect to the axial direction of the barrel cylinder for closing the front end opening and having a slit for allowing the pen point to project and retract; a cylinder portion formed to the rear from the outer periphery of the closing portion; and a holder disposed in the rear of the cylinder portion and fitted into the cylinder portion so as to spread the cylinder bore, and the inner cap is fitted inside the barrel cylinder so that stress that will constantly cause the slit to close always acts on the closing portion; and a holder disposed in the rear of the cylinder portion and filled into the cylinder portion so as to spread the cylinder bore, and the inner cap is fitted inside the barrel cylinder so that the stress that will constantly cause the slit to close always acts on the closing portion;

wherein when the inner cap is not positioned in the inner end of the barrel cylinder the inner cap has a first position where the forward projected portions are a first distance apart from one another thereby creating a first force in a direction perpendicular to the surfaces of the slits, and when the inner cap is positioned in the end of the barrel cylinder the inner cap has a second position where the forward projected portions are a second distance apart from one another thereby creating a second force in a direction perpendicular to the surfaces of the slits, the second distance being smaller than the first distance, and the second force being larger than the first force.

4. The capless writing instrument according to claim 3, wherein the cylinder bore of the inner cap is stretched in the diametrical direction by the range of 5 to 30%, preferably approximately 20%.

5. The capless writing instrument according to claim 3, wherein projections are formed between the cylinder bore of the inner cap and the holder's peripheral cylinder surface, at predetermined positions so as to stretch the cylinder bore of the inner cap in the direction substantially aligned with the cut direction of the slit.

6. The capless writing instrument according to claim 3, wherein the closing portion of the inner cap is projected arch-like toward the front end opening.

* * * * *